United States Patent [19]

Lindström et al.

[11] Patent Number: 4,911,790

[45] Date of Patent: Mar. 27, 1990

[54] PAPER PRODUCTION

[75] Inventors: Tom Lindström, Sollentuna; Hans Hallgren, Stockholm; Fritz Hedborg, Falun, all of Sweden

[73] Assignee: STFI, Sweden

[21] Appl. No.: 141,315

[22] Filed: Jan. 6, 1988

[30] Foreign Application Priority Data

Jan. 9, 1987 [SE] Sweden ..... 8700058

[51] Int. Cl.[4] ..... D21H 3/20

[52] U.S. Cl. ..... 162/175; 162/181.2; 162/181.3; 162/181.5; 162/183

[58] Field of Search ..... 162/181.1, 181.2, 181.3, 162/181.4, 181.5, 183, 175, 177, 178

[56] References Cited

U.S. PATENT DOCUMENTS 3,074,843 1/1963 Lagally et al. ..... 162/181.5
4,487,657 12/1984 Gomez ..... 162/175
4,591,412 5/1986 Hechler ..... 162/181.2
4,710,270 12/1987 Sunden et al. ..... 162/181.1

FOREIGN PATENT DOCUMENTS 708518 4/1965 Canada ..... 162/181.2
1596632 8/1981 United Kingdom .

*Primary Examiner*—Peter Chin
*Attorney, Agent, or Firm*—Brumbaugh, Graves, Donohue & Raymond

[57] ABSTRACT

The present invention relates to a process for obtaining retention of the manufacture of paper, whereby one adds a cationic, high polymer polysaccharide at the preparation of a stock of paper pulp; that one adds an anionic aluminium compound, or a combination of an aluminium salt and an alkali or an acid to the formation in situ of such an anionic aluminium compound immediately prior to the head box, whereby pH immediately prior to the head box is kept at pH 7 to 8.

6 Claims, No Drawings

PAPER PRODUCTION

TECHNICAL FIELD

The present invention relates to a process for providing retention at paper production.

The object of the present invention is to obtain an economically advantageous process for carrying out a formation of paper using an addition of a retention agent at substantially neutral conditions.

A further object is to obtain a high retention and further obtain a good dewatering and pressability of the paper web.

BACKGROUND OF THE INVENTION

Retention agents are generally used in paper production to flocculate dispersed or emulsified colloidal particles such as filling agents, resin dispersions, fibers, and others. The term high retention in this context means that one obtains a high proportion of the stock added to the headbox on the wire after formation.

Example of retention agents used are so called anionic active, or cationic polyacryl amides, modified polyamide amines, polyethylene imines, polyamines, cationic or amphoteric starch derivatives, as well as inorganic chemicals such as aluminium sulphate, etc.

As it is often advantageous to form paper at a low concentration in the headbox, it is also advantageous if the retention chemicals accelerates the dewatering on the wire and in the press parts. A high dry substance after the press is desired as it reduces the drying costs. Hereby each percent of increased dryness is of very great economical importance.

It is previously known from SE-A-78009040-0 to use alum and a cationic starch in a paper forming process, whereby the alum dose is divided in such a way that half the amount of alum is added to the stock in the machine chest, whereupon cationic starch is added close to the head box, and finally the second half of the dose of alum in added close to the head box as well. The method does not, however, give a satisfactorily result with regard to filler retention.

It is also known that one can combine different retention agents with each other, and thereby to obtain strong additive effects with regard to the retention effects of these. It is further known that some combinations of chemicals give the desired effect of simultaneously good retention and dewatering. Among commersially useful systems of chemicals used, COMPOZIL%, a combination of cationic active starch and colloidal silica, and HYDROCOL$^R$, a combination of cationic polyacryl amide and alkali activated montmorillonite clay, can be mentioned.

These systems, however, show a considerably drawback by being economically burdensome on the paper production process.

DESCRIPTION OF THE PRESENT INVENTION

It has now surprisingly been shown possible to be able to fulfill the above given objects and to remove above given drawback according to the previously known technique by means of the present invention, which is characterized in that one adds a cationic, high molecular polysaccharide at the preparation of a stock of paper pulp, optionally comprising filler; that one immediately prior to the head box adds an anionic aluminium compound, or a combination of an aluminium salt and an alkali, or an acid to the formation of an anionic aluminium compound, whereby pH immediately prior to the head box is 7 to 8.

Further characteristics are evident from the accompanying claims.

By means of the present invention a very strong combination effect is obtained by the early addition of cationic, high molecular polysaccharide, and the late addition of aluminium.

Aluminium compounds used can be aluminium sulphate, aluminium chloride, aluminium nitrate, polyaluminium hydroxy complexes of the sulphate and/or chloride types and/or aluminate compounds, particularly sodium and potassium aluminates.

When using aluminium sulphate, aluminium chloride, aluminium nitrate or polyaluminium hydroxy complexes of the sulphate and/or chloride types an alkali such as sodium and potassium hydroxide is added, whereby the relation $Al^{3+}/OH$ should be preferably 1:3.

When adding an aluminate, an acid, such as sulphuric acid, hydrochloric acid, or nitric acid, or another suitable strong acid is added to adjust pH to 7 to 8, and for the formation of anionic aluminium hydroxide, ($Al(OH)_4^-$). In stead of forming the anionic aluminium hydroxide in situ in the stock, a preprepared aluminium hydroxide sol can be added.

Traditionally, one usually adds different types of starch, either by an addition to the stock, or in the size press to improve the strength properties of the paper. When stock addition is used, the starch is normally cationic, or amphoteric (net cationic) to have good affinity to the fiber and filler. The starch is normally dosed to the thick stock, or, if it is also used as a retention agent, close to the head box position.

Aluminium sulphate is traditionally added to make the paper hydrophobic (aluminium sulphate and resin), to regulate the pH value, or to improve the retention of fines in the stock. Alum is usually added to the thick stock, or in the so called short circulation, however, more seldom immediately prior to the head box. Alum is primarily used in so called acidic or neutral stock systems, i.e having a pH of $<7$, where the partially hydrolysed aluminium salt is cationic in its properties.

Cationic, high molecular polysaccharides are primarily cationic starch from different plants, such as potatoes and cereals.

The stock used, such as different sulphite and sulphate pulps, mechanical, chemomechanical, or semichemical pulps may, but need not, contain a filler such as calcium carbonate, kaolin, or gypsum, or combinations of these.

The present invention will be described more in detail in the following without, however, being restricted to the examples given and performed on a laboratory scale (Britt Dynamic Drainage Jar), and on a pilot experimental machine (FEX at STFI).

EXAMPLE 1

The example is given to illustrate the effect of a NaOH addition on the retention effectivity. The object of the NaOH addition is to obtain good growth conditions for an anionic aluminium hydroxide sol formed in situ. The stock, which was tested in a so called BDDJ apparatus consisted of 40% bleached pine sulphate pulp (25 SR), and 40% bleached birch sulphate pulp (25 SR), and 20% of calcium carbonate (DX1). First NaOH was dosed to the stock given a molar equivalent (NaOH- /$Al^{3+}$) of the aluminium sulphate dosage, whereafter laboratory gelatinized (90° C./10 min) cationic (D.S.=0.35) potatoe starch (CATO 102) was added. 25 seconds later the aluminium sulphate was added and the sample was drained in the BDDJ apparatus (1000 rpm), whereby the retention of the filler was determined.

TABLE 1

The effect of the addition of NaOH on the retention of filler in a BDDJ apparatus. 1% of aluminium sulphate added.

| NaOH addition | 2% cationic starch (CATO 102) | 1% cationic starch (CATO 102) |
|---|---|---|
| 0 | 72% | 56% |
| 3 $OH^-/Al^{3+}$ | 96% | 80% |
| 6 $OH^-/Al^{3+}$ | 64% | 76% |

As evident from Table 1 there is an optimal dosage of NaOH to obtain optimal retention. In this case the optimal dosage was equimolar with regard to $Al^{3+}$, but this need not neccessarily be the case in all applications.

EXAMPLE 2

This example shows the effect of an addition of aluminium on the retention of filler. The conditions were the same as in Example 1, except that the dosage of $NaOH/Al^{3+}=3$ was constant during the test.

TABLE 2

The effect of the addition of aluminium sulphate on the retention of filler in a BDDJ apparatus.

| Cationic starch CATO 102 | $Al_2(SO_4)_3$ (%) | Retention of filler (%) |
|---|---|---|
| 2% | 0 | 38 |
| 2% | 0.5 | 72 |
| 2% | 1 | 96 |
| 2% | 2 | 92 |

EXAMPLE 3

In Examples 1 and 2 the aluminium sulphate was added after the addition of cationic starch. Table 3 shows that when using the opposite way of adding, i.e. adding cationic starch after the aluminium sulphate a lower retention efficiency is obtained in the retention agent system ($NaOH/Al^{3+}=3$). (Cf. the values in Table 2).

TABLE 3

The effect of the addition of aluminium sulphate on the retention of filler. Addition of cationic starch after the addition of aluminium sulphate.

| Cationic starch CATO 102 | $Al_2(SO_4)_3$ (%) | Retention of filler (%) |
|---|---|---|
| 2% | 0 | 44 |
| 2% | 0.5 | 56 |
| 2% | 1 | 60 |
| 2% | 2 | 74 |

EXAMPLE 4

The example shows a retention test made on the experimental paper machine (FEX). Sheets were formed in roller moulds at 500 rpm (80 g/m$^2$). 1.9% cationic potatoe starch (jet boiled) and NaOH ($OH/Al^{3+}=3$) was added to the thick stock, whereupon aluminium sulphate was added after sieves and deaerator immediately prior to the head box. The machine system was run completely closed using BV filter, and the filler content of the final paper was 21%.

TABLE 4

The effect of the addition of aluminium sulphate ($NaOH/Al^{3+}$ = 3) on the retention and press dry content.

| | Retention (%) | Press dry content (%) |
|---|---|---|
| 1.9% cationic starch (C.S.) in head box position | 49 | 41 |
| 1.9% C.S. to the thick stock | 38 (no equilibrium) | — (no equilibrium) |
| 1.9% C.S.* + 0.2% aluminium sulphate | 50.5 | 42.7 |
| 1.9% C.S.* + 0.4% aluminium sulphate | 84.3 | 43.7 |
| 1.9% C.S.* + 0.8% aluminium sulphate | 92.2 | 44.2 |

*Cationic starch added to the thick stock.

EXAMPLE 5

The example intends to show the retention at the addition of $Na_2CO_3$. The conditions were the same as those in Example 1 above.

TABLE 5

The effect of the addition of $Na_2CO_3$ on the retention of fines in a BDDJ apparatus. 1% of aluminium sulphate added.

| $Na_2CO_3$ addition | 2% cationic starch (CATO 102) | 1% cationic starch (CATO 102) |
|---|---|---|
| 0 | 72% | 56% |
| 1.5 $CO_3^{2-}/Al^{3+}$ | 98% | 87% |

EXAMPLE 6

This example intends to show the effect of the addition of polyaluminium chloride (without adding alkali) on the effeciency of the retention. The conditions were the same as in Example 1.

The addition of polyaluminium chloride correspond to the same total molar addition of aluminium as 1% aluminium sulphate.

TABLE 6

Comparison between the addition of polyaluminium chloride and of aluminium sulphate on the effeciency of retention.

| | 2% cationic starch (CATO 102) | 1% cationic starch (CATO 102) |
|---|---|---|
| Aluminium sulphate without alkali | 72% | 56% |
| Aluminium sulphate addition with $30H^-/Al^{3+}$ | 96% | 80% |
| Polyaluminium chloride without alkali | 97% | 91% |

EXAMPLE A (COMPARISON)

The process according to Example 1 was repeated with the following exceptions: no alkali was added, and the aluminium sulphate dose was added in such a way that in a first two test it was added prior to the cationic starch, and in a second two tests it was divided in such a way that half the dose was added prior to the cationic starch, in the machine chest, and the second half thereof was added to the head box, after the addition of the cationic starch, i.e. in a way proposed in SE-A-7800904-0.

TABLE 7

The addition order of alum and cationic starch, as well as divided alum dose.

| Alum % | Cationic starch CATO 102, % | Alum % | Filler retention % |
|---|---|---|---|
| 1 | 1 | — | 76 |
| 1 | 2 | — | 60 |
| 0.5 | 1 | 0.5 | 57 |
| 0.5 | 2 | 0.5 | 64 |

As evident from Table 7 a divided alum addition does not give any advantages with regard to filler retention.

Generally the process is utilized in the following way. The paper pulp with its optional addition of filler is dispersed in a beater vat, whereafter the pulp is transported to a machine chest. Here the cationic starch is added, normally 0.3 to 2.5% by weight calculated on the dry contents of paper pulp (including filler), whereupon the new stock is transported via a pump up to a head box of a paper machine on which a paper web is formed. Immediately prior to the head box a dilution water is added, or normally white water from the closed white water system via the so called short circulatin. In this case an alkali in the form of sodium or potassium hydroxide is introduced into the short circulation, whereby pH of the stock increases to 9 to 11. Shortly after, immediately prior to the head box an acidic aluminium salt, normally a commersially available aluminium sulphate, alum, in a relationship of $OH^-/Al^{3+}$ 3:1, whereby pH drops to 7 to 8. The amount of Al, as aluminium sulphate, is 0.2 to 3% by weight, normally 0.2 to 2% by weight, preferably 0.2 to 1% by weight calculated on the paper pulp dry substance (including optional filler). The white water obtained from the wire has thus a pH of 7 to 8, which is very favourable with regard to machinery and apparatuses, as well as it is a favourable pH to the paper formed. Alkali can be added either prior to the addition of cationic starch or after the same. A suitable alkali is NaOH, KOH, $NaHCO_3$ or $Na_2CO_3$.

We claim:

1. A process for providing retention during paper manufacture, consisting essentially of the steps, in sequence, (a) adding a cationic, high molecular weight polysaccharide during preparation of a stock of paper pulp; and (b) subsequently adding an anionic aluminum reagent to the stock of paper pulp immediately before the stock enters the head box, such that the pH of the stock immediately before the head box is from 7 to 8 and wherein the anionic aluminium reagent is selected from the group consisting of an anionic aluminum compound, an aluminum salt combined with an alkali which will generate an anionic aluminum compound wherein the alkali is present in an amount such that the ratio of $OH^-$ to $Al^{3+}$ is from 1:1 to 3:1, and a combination of an aluminate and an acid which will generate an anionic aluminum compound in situ, said aluminate, if selected, being added in an amount of at least 0.1% by weight.

2. The process according to claim 1 wherein the polysaccharide is a cationic starch which is added to the stock in an amount of 0.1 to 3.0% by weight of the stock.

3. The process according to claim 2 wherein the cationic starch is added in an amount of 0.1% to 1.0% by weight of the stock.

4. The process according to claim 1 wherein a polyaluminum hydroxy complex selected from the group consisting of a sulphate type polyaluminum hydroxy complex and a chloride type polyaluminum hydroxy complex is added immediately prior to the head box in an amount of at least 0.1% by weight of the stock.

5. The process according to claim 1 wherein the anionic aluminum reagent is a combination of aluminate and an acid and wherein the acid is added in a small recycle.

6. The process according to claim 1 wherein the anionic aluminum reagent comprises aluminum hydroxide sol wherein said sol is added in an amount corresponding to at least 0.05% by weight aluminum sulphate.

* * * * *